US007935010B2

(12) United States Patent
Cerpok

(10) Patent No.: US 7,935,010 B2
(45) Date of Patent: May 3, 2011

(54) BALL GAME APPARATUS AND METHOD

(76) Inventor: Michael Cerpok, Fountain Hills, AZ (US)

( * ) Notice: Subject to any disclaimer, the term of this patent is extended or adjusted under 35 U.S.C. 154(b) by 59 days.

(21) Appl. No.: 12/419,023

(22) Filed: Apr. 6, 2009

(65) Prior Publication Data

US 2010/0210380 A1 Aug. 19, 2010

Related U.S. Application Data

(60) Provisional application No. 61/207,720, filed on Feb. 17, 2009, provisional application No. 61/207,729, filed on Feb. 17, 2009.

(51) Int. Cl.
*A63B 67/00* (2006.01)

(52) U.S. Cl. ..... 473/470; 473/476; 273/393

(58) Field of Classification Search ..... 473/465–473, 473/476–478; 273/398–402, 348, 336, 393
See application file for complete search history.

(56) References Cited

U.S. PATENT DOCUMENTS 3,415,522 A * 12/1968 Bauer ..... 473/471
3,428,319 A * 2/1969 Engle ..... 273/393
4,744,567 A * 5/1988 Kochmanski et al. ..... 473/470
6,402,642 B1 * 6/2002 Eden et al. ..... 473/471
6,849,010 B1 * 2/2005 Valdeus, Jr. ..... 473/469
2007/0129184 A1 * 6/2007 Anderson ..... 473/470
2009/0143175 A1 * 6/2009 Tarng et al. ..... 473/470
2010/0120559 A1 * 5/2010 Biederman et al. ..... 473/470

OTHER PUBLICATIONS

Diagram Group, Rules of the Game, 1974, pp. 130, 131, "Netball".*

* cited by examiner

*Primary Examiner* — Mark S Graham
(74) *Attorney, Agent, or Firm* — Parson & Goltry; Robert A. Parsons; Michael W. Goltry

(57) ABSTRACT

A method of playing a team sport in which two teams attempt to score goals at opposite ends of a court, the method includes providing a court and rules determining the layout of the court, the length of time for a game and various plays during the game, and penalties. The game is started on the court with a game ball and two teams and either of the two teams upon gaining possession of the game ball becomes the possessing team and the other of the two teams becomes the opposing team. The possessing team must pass the ball between the possessing team's players a minimum number of times before an attempted shot on the opposing team's goal is made, and any player on the possessing team must not possess the ball for a time greater than a time specified by the rules.

13 Claims, 7 Drawing Sheets

BALL GAME APPARATUS AND METHOD

CROSS-REFERENCE TO RELATED APPLICATIONS

This application claims the benefit of U.S. Provisional Application No. 61/207,720, filed 17 Feb. 2009 and U.S. Provisional Application No. 61/207,729, filed 17 Feb. 2009.

FIELD OF THE INVENTION

This invention generally relates to a game or team sport, and equipment for playing the game or team sport.

BACKGROUND OF THE INVENTION

Team sports are extremely popular and there are a great number of them throughout the world. Some well known team sports include baseball, softball, cricket, basketball, hockey, soccer, etc. Each prior art team sport has specific and well established rules and specific equipment to be used. Generally, the well known team sports presently being played are so completely regulated that it is difficult for unrecognized individuals to get together and to form teams or play the sports to simply have fun.

It would be highly advantageous, therefore, to define a new team sport and to define new equipment for playing the new team sport.

Accordingly, it is an object of the present invention to provide a new and improved team sport.

Another object of the invention is to provide a new and improved team sport and new and improved equipment for playing the new team sport.

SUMMARY OF THE INVENTION

Briefly, to achieve the desired objects of the present invention in accordance with a preferred embodiment, provided is a method of playing a team sport in which two teams attempt to score goals at opposite ends of a court, the method includes providing a court and rules determining the layout of the court, the length of time for a game and various plays during the game, and penalties. The game is started on the court with a game ball and two teams and either of the two teams upon gaining possession of the game ball becomes the possessing team and the other of the two teams becomes the opposing team. The possessing team must pass the ball between the possessing team's players a minimum number of times before an attempted shot on the opposing team's goal is made, and any player on the possessing team must not possess the ball for a time greater than a time specified by the rules. In the preferred embodiment, the possessing team must pass the ball between the possessing team's players a minimum of three times and any player on the possessing team must not possess the ball for a time greater than three seconds.

The desired objects of the present invention are further realized in accordance with a specific embodiment of game apparatus including a generally flat, rectangularly shaped base with an upper surface, the base including a positioning element on the upper surface for receiving a goal pin thereon, a backboard hingedly attached to a rear edge of the base so as to have a stored position in which the backboard lies flat on the upper surface of the base and an operative or active position in which the backboard extends upwardly from the rear edge of base at approximately a 90°, and a locking mechanism connected between the base and the backboard in the operative or active position and formed to lock the base and backboard in the operative or active position.

The specific embodiment of game apparatus further includes a free-standing elongated goal pin with a bottom end constructed to be positioned on the positioning element on the upper surface of the base and an upper end extending approximately the height of the backstop above the upper surface of the base, and the goal pin having a weighted element at the bottom end for biasing the goal pin in an upstanding position.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF A PREFERRED EMBODIMENT

Figure 1:
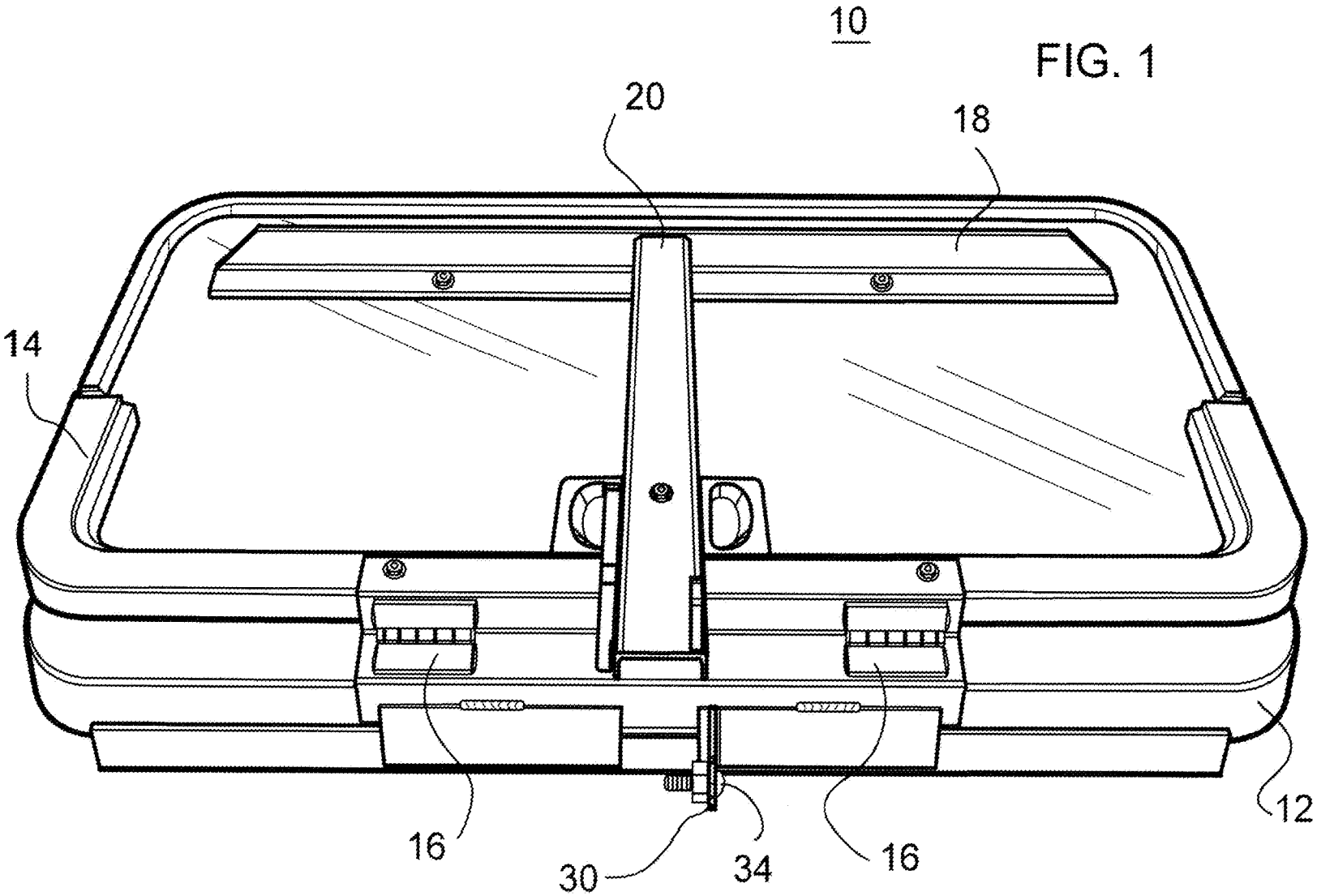
FIGS. 1 and 2 are rear and top perspective views, respectively, of a back-stop in accordance with the present invention, in the stored position.
Figure 2:
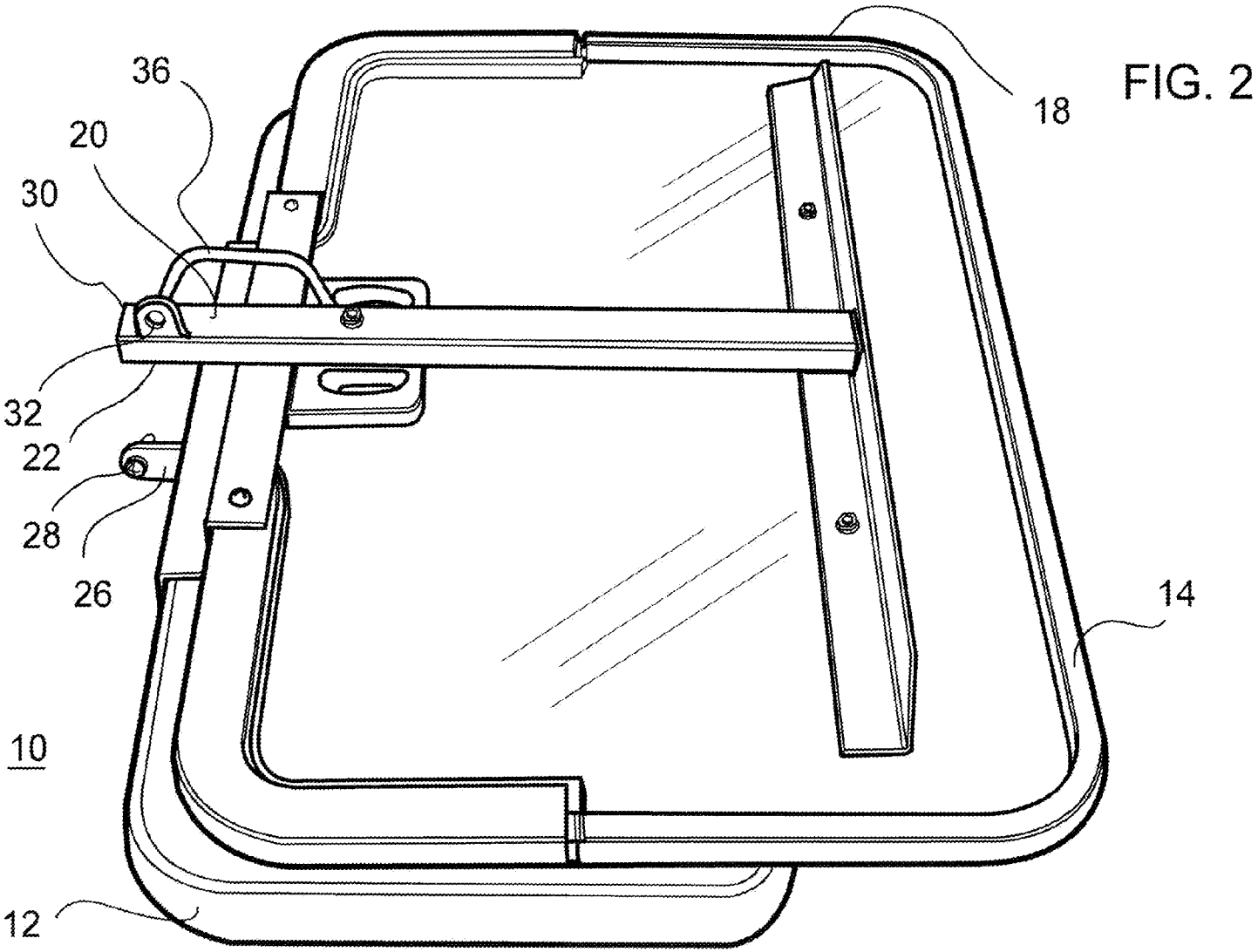
Figure 3:
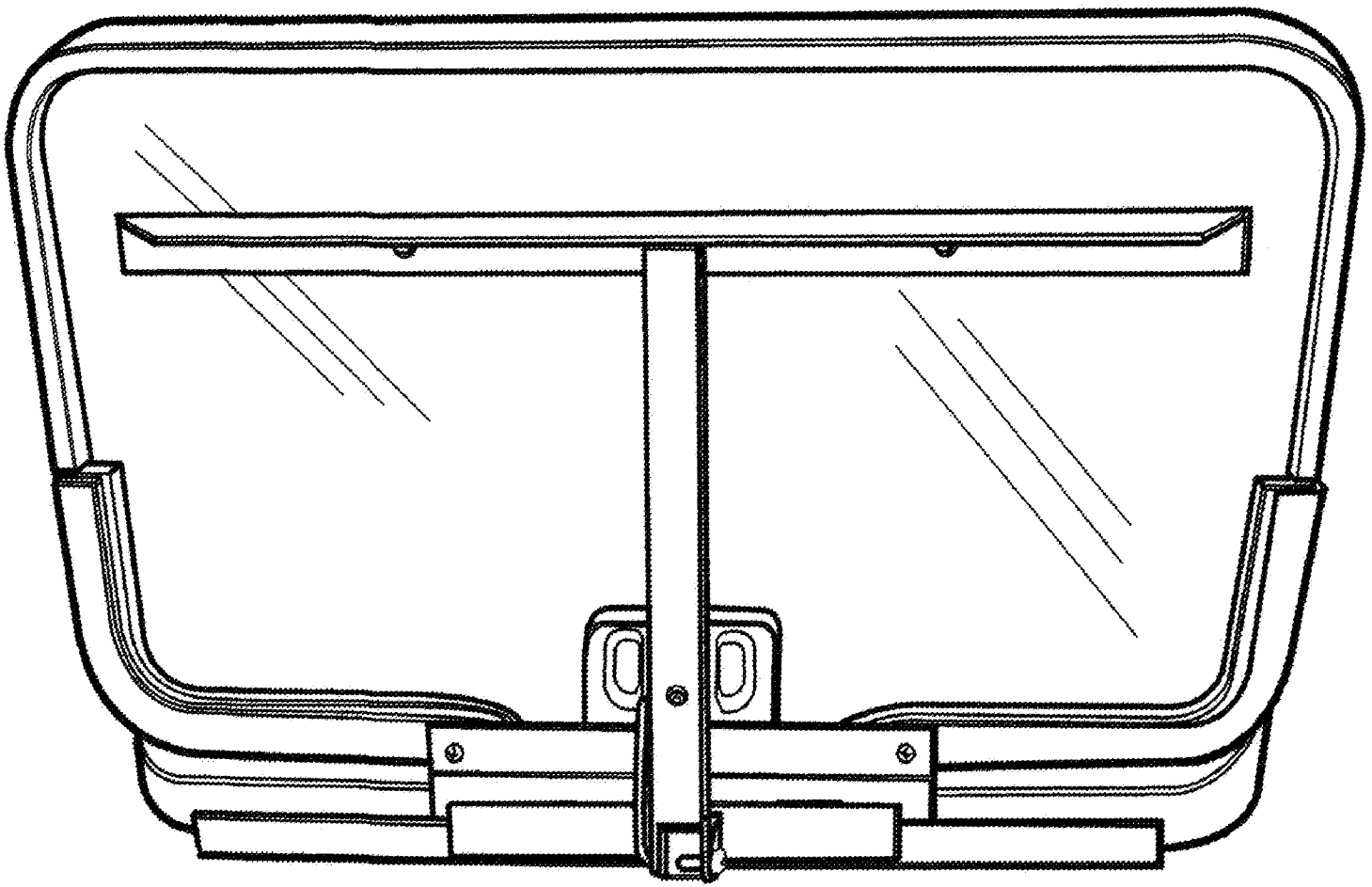
FIGS. 3, 4, and 5 are rear, top side, and top rear perspective views, respectively, of the back-stop of FIG. 1 in the open or operating position.
Figure 4:
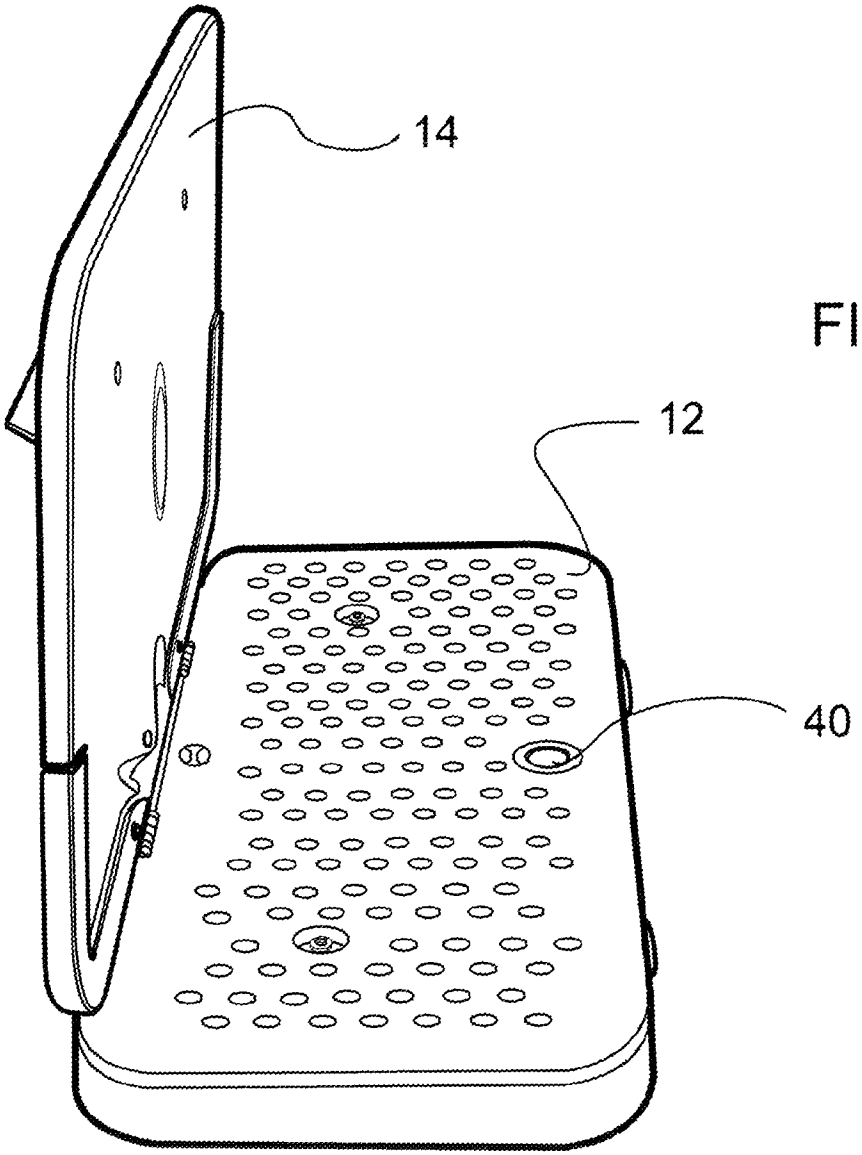
Figure 5:
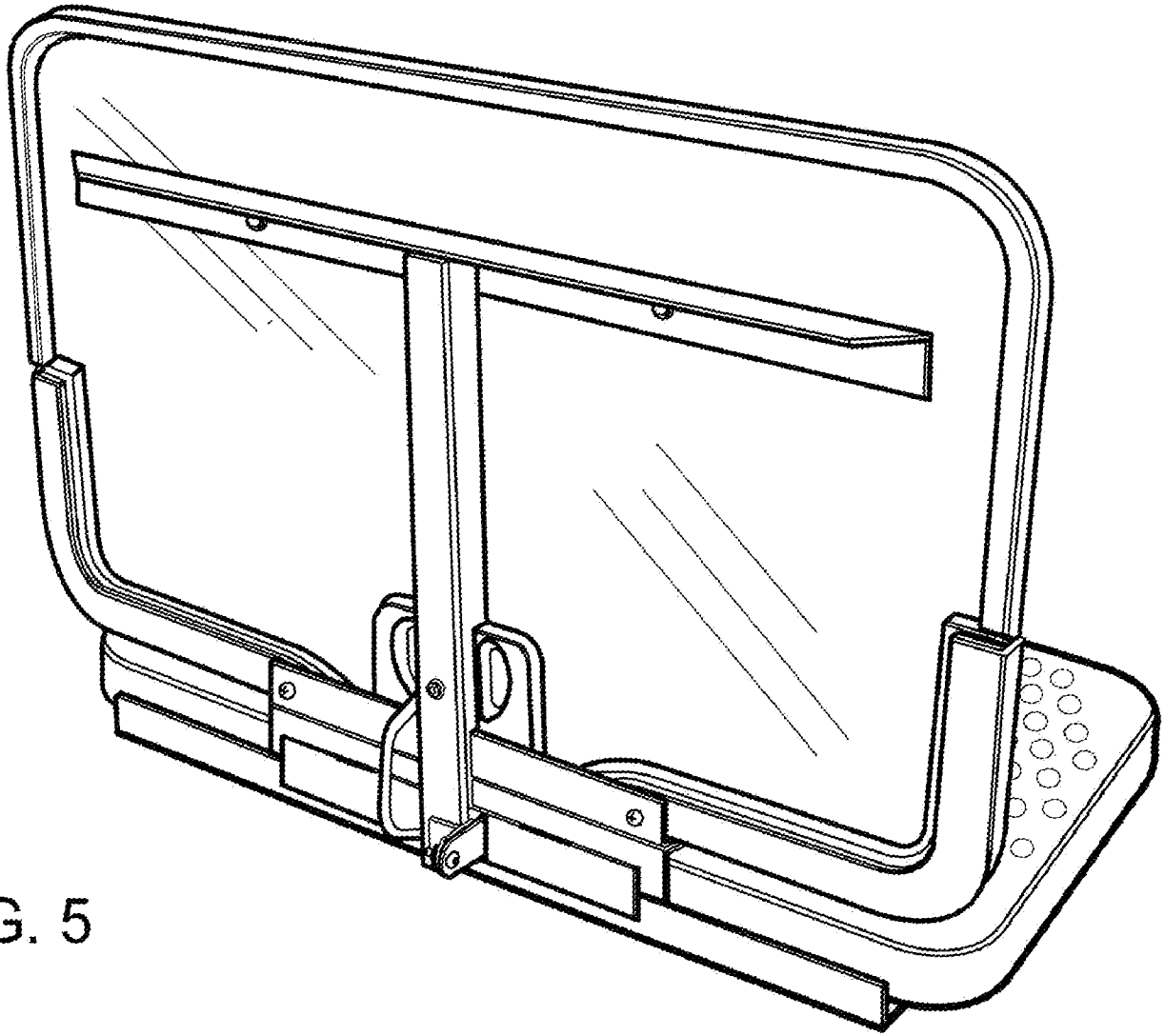
Figure 6:
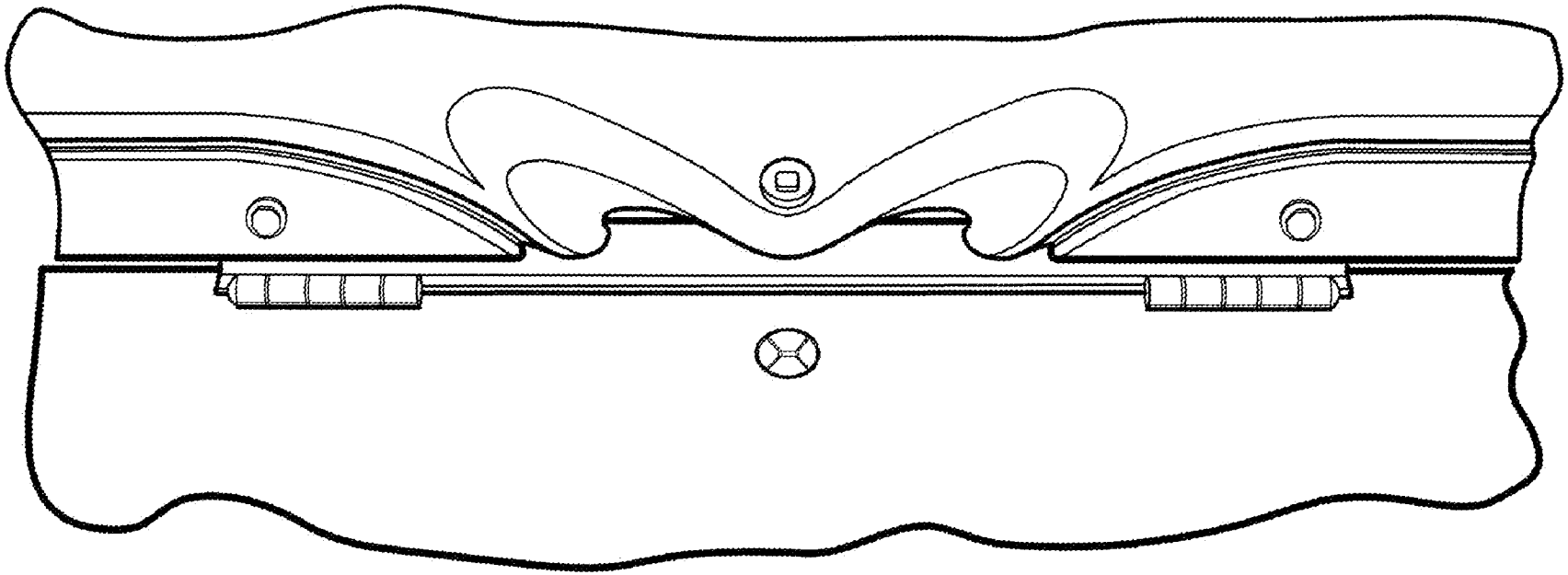
FIG. 6 is an enlarged top perspective view of a portion of the back-stop of FIG. 1.

Turning now to the drawings, attention is first directed to FIGS. 1 and 2 which illustrate an embodiment of a back-stop 10 for the sport of the present invention, in a folded or stored position. Back-stop 10 includes a generally flat, rectangularly shaped base 12 and a backboard 14. Backboard 14 is hingedly attached to a rear edge of base 12 by hinges 16 so as to have a stored position in which backboard 14 lies flat on the upper surface of base 12, as illustrated in FIGS. 1 and 2 and an operative or active position in which backboard 14 extends upwardly from the rear edge of base 12 at approximately a 90° angle, as illustrated in FIGS. 3, 4, and 5.

In this specific embodiment, a metal angle 18, such as angel iron or an aluminum angel, extends horizontally across the rear surface of backboard 14 a short distance below the upper edge to add strength to backboard 14. An elongated brace 20 is attached to the rear surface of backboard 14 and extends downwardly from engagement with metal angle 18 to a short distance past the lower edge of backboard 14. The lower portion, designated 22, of brace 20 that extends beyond the lower or rear edge of backboard 14 is sufficiently long to extend substantially the thickness of base 12, i.e. the lower end of portion 22 extends to just short of a supporting surface (e.g. the ground, etc.) when backboard 14 is in the operative or active position.

An operative or active position locking mechanism is connectable between base 12 and backboard 14 to lock backboard 14 in the operative or active position. In the present embodiment to perform this function an outwardly or rearwardly extending flange 26 is affixed to the rear surface of base 12. Flange 26 has a hole 28 therethrough adjacent the rear end thereof. An outwardly extending, mating flange 30 is affixed to the upper or rear surface of brace 20 and a hole 32 therethrough is positioned to be aligned with hole 28 when backstop 14 is in the operative or active position. A bolt, pin, or the like, designated 34, can then be inserted through aligned holes 28 and 32 to lock backstop 14 in the operative or active position. Also, a carrying handle 36 is affixed to the rear surface of brace 20 so that backstop 10 can be easily transported to any desired location.

The front surface of backboard 14 is substantially flat so that a ball (used in play) will bounce off the surface without being misdirected by irregularities. Also, the back surface, in this embodiment, includes a type of "waffle weave" to increase the strength while substantially reducing the overall weight. The upper surface of base 12 includes a positioning element 40 located approximately centrally along the longitudinal axis (i.e. parallel to the front and rear edges) and set back a short distance from the front edge. Positioning element 40 can simply be a spot provided to aid in properly positioning a goal pin 50 (described in more detail below) and/or it can include some electronics coupled to an indicator either in backstop 14 or at some remote location. The indicator can, for example, indicate when goal pin 50 has been moved from positioning element 40.

In the preferred embodiment, base 12 of back-stop 10 is approximately 42 inches wide (i.e. along the longitudinal axis or along each of the front and rear edges). Also, base 12 is approximately 21 inches deep (i.e. between the front and rear edges) and approximately 4 inches high (i.e. from the lower surface to the upper surface). Backboard 14 of back-stop 10 is 42 inches wide and 27 inches high in the operative or active position. Also, backboard 14 is approximately 1.5 inches deep to provide sufficient strength without producing too much weight. Back-stop 10 can be formed of blow molded, roto-molded, and the like, elements (base 12, backboard 14) that are hollow. Thus, they can be readily transported and stored due to light weight, but when water or sand ballast is added to the hollow elements, are firmly established for the game.

Figure 7:
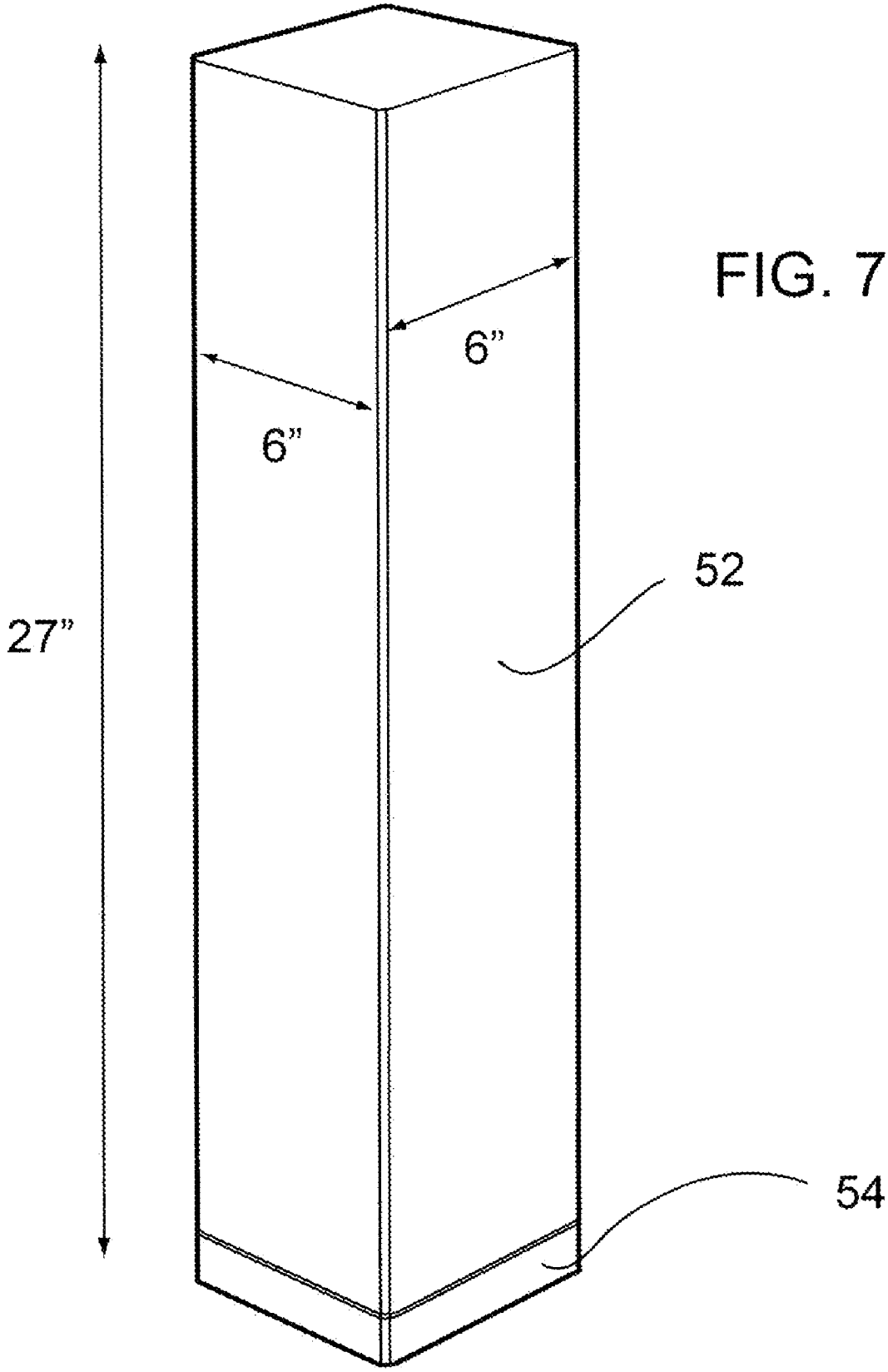
FIG. 7 is a view in perspective of a Pin in accordance with the present invention.

Turning now to FIG. 7, goal pin 50 is illustrated in detail. For ease in understanding and to assure an association of goal pin 50 with the ball game. In this specific embodiment goal pin 50 includes a body 52 and a fixedly attached base 54. Body 52 is an elongated, element with a generally rectangularly shaped cross-section. Goal pin 50 is a free-standing goal pin that is it simply rests on its base with no support other than the pin construction. In the preferred embodiment goal pin 50 is approximately 27 inches long (or high in the upright position) and is approximately 6 inches wide and deep (i.e. six inches on each side). Further, body 52 of goal pin 50 is formed of a light but strong foam material, generally with a covering to add strength. The covering may be some strong material such as leather, plastic, etc. Base 52 may be covered with the same material and may, for example, simply be a compartment formed in the material at the lower end of body 52. Base 52 is six inches on each side and sufficiently deep to contain approximately one pound of sand or other weighting material.

The ball game is played on a flat surface that is preferably smooth, such as packed dirt, concrete, macadam ('black-top'), or even grass. A court is marked out and is 30 feet wide by 60 feet long. A center line is marked 30 feet from either end and extends across the width of the court. A back-stop 10 is placed, one each, at each end of the court approximately midway between the sides of the court. A goal pin 50 is placed on positioning element 40 of each back-stop 10. The back of back-stop 10 and the end of the court define a goal line. A Goalie Box, six feet wide and 6 feet deep is clearly marked at each end of the court and each one includes back-stop 10 situated at the rear end and approximately centrally located relative to the outer edges. A No-Shot Zone is clearly marked and extends six feet forward from the goal line and the width of the court. A Tip-Off Circle is clearly marked at center court (extending concentrically around a center point of the court) and is approximately 10 feet in diameter.

Ball Game Rules

As will be understood, the rules of the ball game as set forth below are considered the Official Rules and may vary slightly in accordance with specific applications and instances. For purposes of consistency, the court dimensions and layout specified above is considered section 1 of the rules so that the rules as specified below are designated sections 2 through 5 and will be numbered accordingly for convenience of reference. It will be understood by those of ordinary skill that the numbers, sections, and paragraphs are only added for convenience in use and later reference and otherwise are not a part of this invention.

2.1 Ideally, three officials will call each game; however the number is optional and can vary from none to more than three is desired. The three officials include a Referee, a Timer, and a Judge. The Referee will call warnings, penalties, and goals and have the final say in disputes. The Timer will time ball possession and consecutive passes. The Judge will keep track of the time for game clock, time-outs, and penalties.

Section 2

2.2 The game, initially, and each subsequent period begin with a tip-off. Only one player from each team may occupy the Tip-Off Circle during the tip-off.

2.3 The game consists of three equal periods and each period lasts twenty minutes with a five minute intermission between periods.

2.4 Each team is allowed three 30 second time-outs per period, and must be in possession of the ball to call a time-out. The Referee may call time-out for penalties, player warnings, and injuries. The Judge will stop the game clock for time-out durations unless playing with a "running clock".

2.5 One point is awarded for knocking down the opposing team's goal pin, when no infraction is committed.

2.6 The team in possession of the ball must complete at least three consecutive passes before attempting a shot.

2.7 No player may be in possession of the ball for more than three seconds before attempting a pass.

2.8 A player's foot may not land into the No-Shot Zone before shooting. A player receiving the ball while occupying the No-Shot Zone must exit the Zone completely before attempting a shot on goal. A goal made while the player taking a shot is in the No-Shot Zone will be dis-allowed.

2.9 No player, other than a team's designated goalie may occupy the Goalie Box, nor attempt to retrieve a ball that lies within the box. Breaking the 'plane' of the Goalie Box is considered an infraction. The Referee must be notified, and acknowledge, before switching goalies.

2.10 When play is started from the Goalie Box, the three second time begins with the Referee's whistle. The goalie is not allowed to dribble or otherwise attempt to restart the three second time while in the Goalie Box.

2.11 A player may re-start the team's three second time by intentionally dropping the ball (dribbling) or throwing the ball up into the air (so long as the ball achieves a height higher than the player's own head). However, this also re-starts the three pass rule. Bouncing the ball off of another player restarts the three second time without restarting the three pass rule.

Section 3

3.1 Play will be stopped and a change of possession will be called by either the Referee or the Timer in the following instances:

3.2 A defensive player takes, or knocks free, a ball already in possession of the opposing team. The opposing team is allowed to maintain possession. A delayed whistle is used!

Play is not stopped if the opposing team immediately regains possession of the ball. If play is stopped, the goalie must start play from the Goal Box.

3.3 A warning or penalty is called. A delayed whistle is used! A stoppage in play caused by a warning or penalty occurs after the offending team takes control of the ball. An offensive player (not the goalie) on the non-offending team takes possession of the ball at center court.

3.4 The ball is deemed to be "out of bounds" by the Referee or Timer. Play starts in the Goalie Box.

3.5 A goal has been scored. Play starts in the Goalie Box.

3.6 A center court tip off will be called when play is stopped due to opposing players having equal possession of the ball.

3.7 Opposing goalie takes possession of the ball when a shot is blocked out of bounds. Play starts in the goalie box.

Section 4

4.1 When a team is penalized, they must play "short handed" for the duration of the penalty or until the stated number of "power play" goals are scored, whichever is shorter.

4.2 The Referee may choose to give a warning to a player for entering the Goalie Box (Goalie Interference), incidental contact, or pin-tipping. Any player receiving three warnings in a single game will be issued a mandatory Minor Penalty upon the next infraction.

4.3 A Minor Penalty is two minutes in duration and ends earlier if the opposing team scores a goal during the penalty.

4.4 A Major Penalty is five minutes in duration and ends earlier if the opposing team scores two goals during the penalty.

4.5 A Misconduct Penalty is ten minutes in duration and ends earlier if the opposing team scores four goals during the penalty.

4.6 A Game Misconduct Penalty is ten minutes in duration, to be served by an alternate team member with the offending team member ejected from the game.

4.7 The player upon whom the infraction occurred is allowed a shot on goal defended by only the goalie.

4.8 During a penalty shot. All players must exit the field. The player awarded the penalty shot starts at mid-court. The Referee takes a position half way between mid-court and the Goal Line. The player has three seconds from the time he passes the Referee to take his shot. No-Shot Zone restrictions apply. After the shot, the defending goalie takes possession of the ball in his Goalie Box.

4.9 A penalty shot will be made mandatory when any player who has committed more than three Minor Penalties or two Major Penalties in a single game receives subsequent penalties. After three penalty shots have been levied against a single player, said player will receive a Game Misconduct Penalty upon the fourth infraction. Any player receiving a second Misconduct Penalty in any one game will immediately receive a Game Misconduct Penalty.

4.10 A penalty shot is awarded, at the Referee's discretion, when a goalie knocks over his own pin (Pin Tipping) while facing an unobstructed shot or "break-away" even if incidental contact causes the pin to fall over.

Section 5

5.1 Players on both teams have an equal right to a loose ball. Incidental contact is allowed, and is called "non-incidental" at the Referee's discretion. No player may use their body to attempt to knock the ball loose from another player.

5.2 A player in possession of the ball has the right to move with the ball in any direction, however, a defensive player also has the right to remain in their position. If contact occurs between two players due to exercise of these rights, it left to the Referee's discretion as to whether or not contact was incidental.

5.3 Minor Penalties will be issued for the following infractions:

Non-incidental contact:
Elbowing an opposing player;
Goalie interference;
Excessive incidental contact;
Holding an opposing player;
Tipping a pin;
Tripping an opposing player; and
Unsportsmanlike conduct.

5.4 Major Penalties will be issued for the following infractions:

Kicking an opposing player;
Excessive non-incidental contact; and
Unsportsmanlike conduct by a coach.

5.5 Misconduct Penalties will be issued for the following infractions:

Gross unsportsmanlike conduct by a coach or player.

5.6 Game Misconduct will be issued for the following infractions:

Intent to injure another player: and
Physical contact with an Official.

The rules listed above are intended to make the ball game fair, continuous and injury free. Further, a prime purpose of the ball game is to provide a sport in which virtually anyone can participate and which will provide the participants with exercise and fun. Thus, a new and improved team sport and new and improved equipment for playing the new team sport have been disclosed.

Various changes and modifications to the embodiment herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A method of playing a team sport in which two teams attempt to score goals at opposite ends of a court, the method including the steps of:

providing a court and rules determining the layout of the court, the length of time for a game and various plays during the game, and penalties;

providing a back-stop at each end of the court at ground level, each back-stop with a base having an upper surface, the base including a positioning element on the upper surface for receiving a goal pin thereon, a backboard attached to a rear edge of the base, the backboard extending upwardly from the rear edge of the base; and providing a free-standing elongated goal pin with a bottom end constructed to be positioned on the positioning element on the upper surface of the base with the goal pin in an upstanding position;

starting a game on the court with a game ball and two teams;

either of the two teams upon gaining possession of the game ball becomes the possessing team and the other of the two teams becomes the opposing team, the possessing team must pass the ball between the possessing team's players a minimum number of times before an attempted shot on the opposing team's goal is made, and any player on the possessing team must not possess the ball for a time greater than a time specified by the rules; and a goal includes knocking down the goal pin of the opposing team from the upstanding position.

2. A method as claimed in claim 1 wherein the minimum number of times for passing the ball between the possessing team's players is three.

3. A method as claimed in claim 1 wherein the time specified by the rules is three seconds.

4. A method as claimed in claim 1 wherein the step of providing a back-stop at each end of the court and a free-standing goal pin includes;

providing a back-stop with a generally flat, rectangularly shaped base with an upper surface, the base including a positioning element on the upper surface for receiving a goal pin thereon, a backboard attached to a rear edge of the base so as to have a stored position in which the backboard lies flat on the upper surface of the base and an operative or active position in which the backboard extends upwardly from the rear edge of base at approximately a 90°, and a locking mechanism connected between the base and the backboard in the operative or active position and formed to lock the base and backboard in the operative or active position; and providing a free-standing elongated goal pin with a bottom end constructed to be positioned on the positioning element on the upper surface of the base and an upper end extending approximately the height of the backstop above the upper surface of the base, and the goal pin having a weighted element at the bottom end for biasing the goal pin in an upstanding position.

5. A method as claimed in claim 1 wherein the step of providing a court includes providing a goalie box around the back stop and goal pin.

6. A method as claimed in claim 1 wherein the step of providing penalties includes providing definitions of minor penalties, major penalties, and misconduct penalties, and providing a penalty time for each of the penalties including a shorter one of a specified time for holding a penalized player out of the game and a time required for the opposing team to make a specified number of goals during the penalty time.

7. A method as claimed in claim 6 wherein the penalty time for a minor penalty includes the shorter one of two minutes and the time required to make one goal.

8. A method as claimed in claim 6 wherein the penalty time for a major penalty includes the shorter one of five minutes and the time required to make two goals.

9. A method as claimed in claim 6 wherein the penalty time for a misconduct penalty includes the shorter one of ten minutes and the time required to make four goals.

10. A method of playing a team sport in which two teams attempt to score goals at opposite ends of a court, the method including the steps of:

providing a court and rules determining the layout of the court, the length of time for a game and various plays during the game, and penalties;

providing a back-stop at each end of the court at ground level, each back-stop with a base having an upper surface, the base including a positioning element on the upper surface for receiving a goal pin thereon, and a backboard attached to a rear edge of the base, the backboard extending upwardly from the rear edge of the base; and providing a free-standing elongated goal pin with a bottom end constructed to be positioned on the positioning element on the upper surface of the base, and the goal pin having a weighted element at the bottom end for biasing the goal pin in an upstanding position;

a goal includes knocking down the goal pin of the opposing team from the upstanding position;

starting a game on the court with a game ball and two teams;

either of the two teams upon gaining possession of the game ball becomes the possessing team and the other of the two teams becomes the opposing team, the possessing team must pass the ball between the possessing team's players a minimum number of three times before an attempted shot on the opposing team's goal is made, and any player on the possessing team must not possess the ball for a time greater than three seconds; and the step of providing penalties including providing definitions of minor penalties, major penalties, and misconduct penalties, and providing a penalty time for each of the penalties including a shorter one of a specified time for holding a penalized player out of the game and a time required for the opposing team to make a specified number of goals during the penalty time.

11. A method as claimed in claim 10 wherein the penalty time for a minor penalty includes the shorter one of two minutes and the time required to make one goal.

12. A method as claimed in claim 10 wherein the penalty time for a major penalty includes the shorter one of five minutes and the time required to make two goals.

13. A method as claimed in claim 10 wherein the penalty time for a misconduct penalty includes the shorter one of ten minutes and the time required to make four goals.

* * * * *